US006811873B2

(12) United States Patent
Nadkarni

(10) Patent No.: US 6,811,873 B2
(45) Date of Patent: Nov. 2, 2004

(54) SELF-CRIMPING MULTICOMPONENT POLYMER FIBERS AND CORRESPONDING METHODS OF MANUFACTURE

(75) Inventor: Vikas Nadkarni, Pune (IN)

(73) Assignee: Hills, Inc., West Melbourne, FL (US)

( * ) Notice: Subject to any disclaimer, the term of this patent is extended or adjusted under 35 U.S.C. 154(b) by 0 days.

(21) Appl. No.: 10/276,310

(22) PCT Filed: May 31, 2001

(86) PCT No.: PCT/US01/17526

§ 371 (c)(1),
(2), (4) Date: Jun. 3, 2003

(87) PCT Pub. No.: WO01/92612

PCT Pub. Date: Dec. 6, 2001

(65) Prior Publication Data

US 2004/0013877 A1 Jan. 22, 2004

Related U.S. Application Data

(60) Provisional application No. 60/208,036, filed on May 31, 2000.

(51) Int. Cl.[7] ..... D01F 8/00
(52) U.S. Cl. ..... 428/370; 428/373; 428/374
(58) Field of Search ..... 428/370, 373, 428/374

(56) References Cited

U.S. PATENT DOCUMENTS 3,219,739 A 11/1965 Breen et al.
3,570,235 A 3/1971 Fukuhara et al.
3,595,738 A 7/1971 Clarke et al.
3,718,534 A 2/1973 Okamoto et al.
4,522,773 A 6/1985 Menezes et al. ..... 264/167
5,093,061 A 3/1992 Bromley et al.

FOREIGN PATENT DOCUMENTS

| | | |
|---|---|---|
| EP | 0 586 924 | 3/1994 |
| EP | 0 908 544 | 4/1999 |
| GB | 1 157 433 | 7/1969 |
| JP | 57 056517 | 5/1982 |

*Primary Examiner*—N. Edwards
(74) *Attorney, Agent, or Firm*—Edell, Shapiro & Finnan, LLC

(57) ABSTRACT

A self-crimping multicomponent fiber is manufactured utilizing the same-polymer components including at least one polymer component having a higher viscosity than at least one other polymer component. Crimping of the fiber is induced during fiber formation by achieving an effective crystallinity differential between the differing viscosity polymer components. The effective crystallinity differential may be obtained by varying a number of parameters during fiber formation, including the viscosity differential between polymer components and the transverse cross-sectional geometries of the differing viscosity components. Other factors, such as selecting a suitable drawing tension for the fiber can influence the crystallinity differential between differing viscosity components and thus resultant fiber crimp.

23 Claims, 3 Drawing Sheets

SELF-CRIMPING MULTICOMPONENT POLYMER FIBERS AND CORRESPONDING METHODS OF MANUFACTURE

CROSS REFERENCE TO RELATED APPLICATIONS

This application claims the benefit of U.S. Provisional Application No. 60/208,036, filed May 31, 2000, entitled "Self-Crimping Fully Drawn Yarn (FDY) of Polyester". The disclosure of this application is incorporated herein by reference in its entirety.

BACKGROUND OF THE INVENTION

1. Technical Field

The present invention relates to fibers having self-crimping characteristics, wherein the fibers are composed of two or more polymers of differing viscosities, and corresponding methods for producing such self-crimping fibers.

2. Description of the Related Art

Woven and non-woven fabrics and yarns having desirable qualities can be manufactured from crimped side-by-side, bicomponent synthetic polymer fibers. Such bicomponent fibers typically include two different polymers arranged as microfilaments or segments across the transverse cross section of the fiber, which segments extend continuously along the length of the fiber. A melt spinning process involving extrusion of the molten polymer from orifices of a spinneret can be used to form these side-by-side bicomponent fibers. By causing one or both of the constituent segments to crimp after extrusion, a fine denier fabric or yarn can be produced with improved characteristics, such as greater bulkiness and softness, superior flexibility and drape, and better barrier and filtration properties for use in products such as disposable absorbent articles, medical garments, filtration materials, apparel, and carpet.

It is well known in the art to produce certain bicomponent fibers having the ability to crimp based upon different thermal shrinkage and/or strain characteristics. For example, U.S. Pat. No. 5,093,061 to Bromley et al., the disclosure of which is incorporated herein by reference in its entirety, discloses melt spinning sub-streams of incompatible polymers having significantly different thermal shrinkage characteristics, such as nylon and polyethylene terephthalate (PET), to incorporate a latent helical crimp into the extruded fiber. Additionally, it is known to manufacture self-crimping polyester fibers by melt spinning polybutylene terephthalate (PBT) and PET in a side-by-side manner. The PBT/PET fiber typically exhibits desired crimping characteristics due to the PBT side becoming crystalline while the PET side remains amorphous thus establishing a strain differential between the two components during drawing of the fiber after extrusion. Methods such as these for providing self-crimping fibers are typically disadvantageous because of the increased material and/or manufacturing costs associated with providing two or more different polymers having suitably different physical properties to induce crimping.

Other processes are known in the art for inducing crimping characteristics in bicomponent fibers including two or more of the same polymers. However, those processes typically require manufacturing steps that are complex and require considerable expense for mass production of the self-crimping fibers. For example, U.S. Pat. No. 4,522,773 to Menezes et al., the disclosure of which is incorporated herein by reference in its entirety, discloses a process for producing self-crimping polyester yarns having the same-polymer components, wherein the process includes extruding a plurality of molten streams of polyester at different extrusion speeds and combining the streams to form thick and thin regions in the combined streams out of phase with each other. The combined streams are then quenched and transformed into solid filaments, passed through a conditioning zone provided with a gaseous atmosphere at a temperature sufficient to produce filaments exhibiting a desired yarn shrinkage and wound at a substantially constant wind-up speed. Menezes is limited in that the process requires a significant modification to the fiber forming equipment to ensure that polymer components achieve differing extrusion velocities prior to combining with each other.

Another known process of forming self-crimping fibers utilizing the same-polymer components is disclosed in U.S. Pat. No. 3,718,534 to Okamoto et al., the disclosure of which is incorporated herein by reference in its entirety. The Okamoto et al. process discloses the combination of two or more of the same-polymer components in the core of a sheath/core melt extruded filament, wherein the same-polymer components have different heat shrinkage or elongation properties. Upon extrusion of the polymer components as the core within a second polymer sheath, the second polymer sheath is removed by dissolution in a solvent to expose the core portion filament. The resultant filament is further processed, e.g., by heating or stretching, to induce crimping. The Okamoto et al. process is limited in that the manufacturing step of providing and subsequently removing a sheath to form the finished fiber increases production costs considerably.

A process for producing a side-by-side self-crimping fiber having the same-polymer components is highly desirable due to the reduced costs associated with obtaining the raw material components. However, attempts at obtaining such fibers without substantial modification to conventional fiber production equipment and/or processing steps (e.g., the processing steps required in Menezes et al. and Okamoto et al.) have typically met with failure. For example, the production of a side-by-side PET/PET self-crimping fiber utilizing conventional melt spinning techniques has been unsuccessful due to the side-by-side PET components exhibiting similar physical properties during fiber production. Both side-by-side PET portions remain amorphous during drawing of the fiber after extrusion which prevents the formation of a stable fiber crimp.

It is therefore desirable to provide a self-crimping fiber having two or more of the same polymer components (e.g., PET/PET) that exhibits a desirable and stable crimp and maybe easily and economically manufactured.

SUMMARY OF THE INVENTION

Therefore, in light of the above, and for other reasons that become apparent when the invention is fully described, an object of the present invention is to produce self-crimping fibers utilizing two or more of the same-polymer components without the need for additional complex or expensive manufacturing steps.

Another object of the present invention is to manufacture self-crimping fibers from two or more of the same-polymer components and having a desirable crimp stability. A further object of the present invention is to produce yarns, fabrics and other textile products having improved characteristics from self-crimping fibers including two or more of the same-polymer components.

Yet another object of the present invention is to produce a multicomponent fiber utilizing at least two of the same-polymer components wherein a suitable crystallinity differential develops between at least two components during formation of the fiber to induce a stable crimp in the fiber.

The aforesaid objects are each achieved individually and in combination, and it is not intended that the present invention be construed as requiring two or more of the objects to be combined unless expressly required by the claims attached hereto.

In accordance with the present invention, the previously noted difficulties in forming a self-crimping fiber with same-polymer components is overcome by establishing an effective crystallinity differential between at least two of the polymer components that induces a stable crimp in the fiber prior to being subjected to a final heat setting treatment. The crystallinity differential between the two polymer components is typically achieved by selecting a suitable viscosity differential between at least two of the same-polymer components in combination with selecting a suitable geometry of the two components with respect to each other as the components are extruded through a spinneret hole. The geometries of the polymer components are typically configured such that higher viscosity polymer components of the fiber have transverse cross sections that are relatively thin and flat and have high perimeter-to-area ratios. Preferably, the transverse dimensions of the polymer components having differing viscosities are selected so that the higher viscosity polymer components have greater perimeter-to-area ratios than that of the lower viscosity polymer components.

A self-crimping fiber manufactured according to the present invention (e.g., a side-by-side PET/PET fiber) will exhibit stable crimping characteristics similar to self-crimping fibers produced with two or more different polymer components (e.g., PET/PBT). Additionally, a self-crimping fiber of the present invention can be formed into yarns and fabrics with superior characteristics, such as greater bulkiness and softness, superior flexibility and drape, and better barrier and filtration properties for use in products such as disposable absorbent articles, medical garments, filtration materials, apparel, and carpet.

Thus, self-crimping fibers manufactured in accordance with the present invention overcome the previously noted difficulties in obtaining stable crimping fibers having two or more of the same-polymer components. The fibers of the invention maybe manufactured utilizing the same-polymer components, thereby reducing material costs and additional manufacturing steps.

The above and still further objects, features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

DESCRIPTION OF THE PREFERRED EMBODIMENTS

The following detailed explanations of FIGS. 1-6 and of the preferred embodiments reveal the novel methods, apparatus and fibers of the present invention. According to the present invention, a self-crimping multicomponent fiber is formed from at least two of the same-polymer components having differing viscosities, wherein, upon extrusion, quenching and drawing of the fiber, stable self-crimping fiber is achieved as a result of an effective crystallinity differential between the differing viscosity components being developed during fiber formation. As used herein, the term "fiber" includes fibers of finite length, such as conventional staple fibers, as well as substantially continuous structures, such as filaments, unless otherwise indicated. The term "multicomponent fiber" refers to a fiber that includes at least two of the same-polymer components forming substantially distinct portions and having substantially distinct boundaries. The multicomponent fiber may include other polymer components that are different from the same-polymer components. The multicomponent fiber may be of any type including, without limitation, a side-by-side or a sheath-core fiber. The term "same-polymer components" as used herein refers to two or more polymers having substantially the same repeating structural unit. For instance, the same-polymer components for a multicomponent fiber of the present invention could be PET components, wherein the repeating unit for each PET component is $[C_{10}H_8O_4]_k$. It is noted, however, that the same-polymer component fibers are capable of having different viscosities. The term "self-crimping" as used herein refers to spontaneous crimping characteristics exhibited by a fiber upon being subjected to a suitable amount of strain and/or heat. Further, the term "effective crystallinity differential" as used herein refers to a difference in degree of crystallinity during formation between higher and lower viscosity polymer components making up the multicomponent fiber that is effective to yield a self-crimping fiber with stable crimping characteristics.

Figure 1:
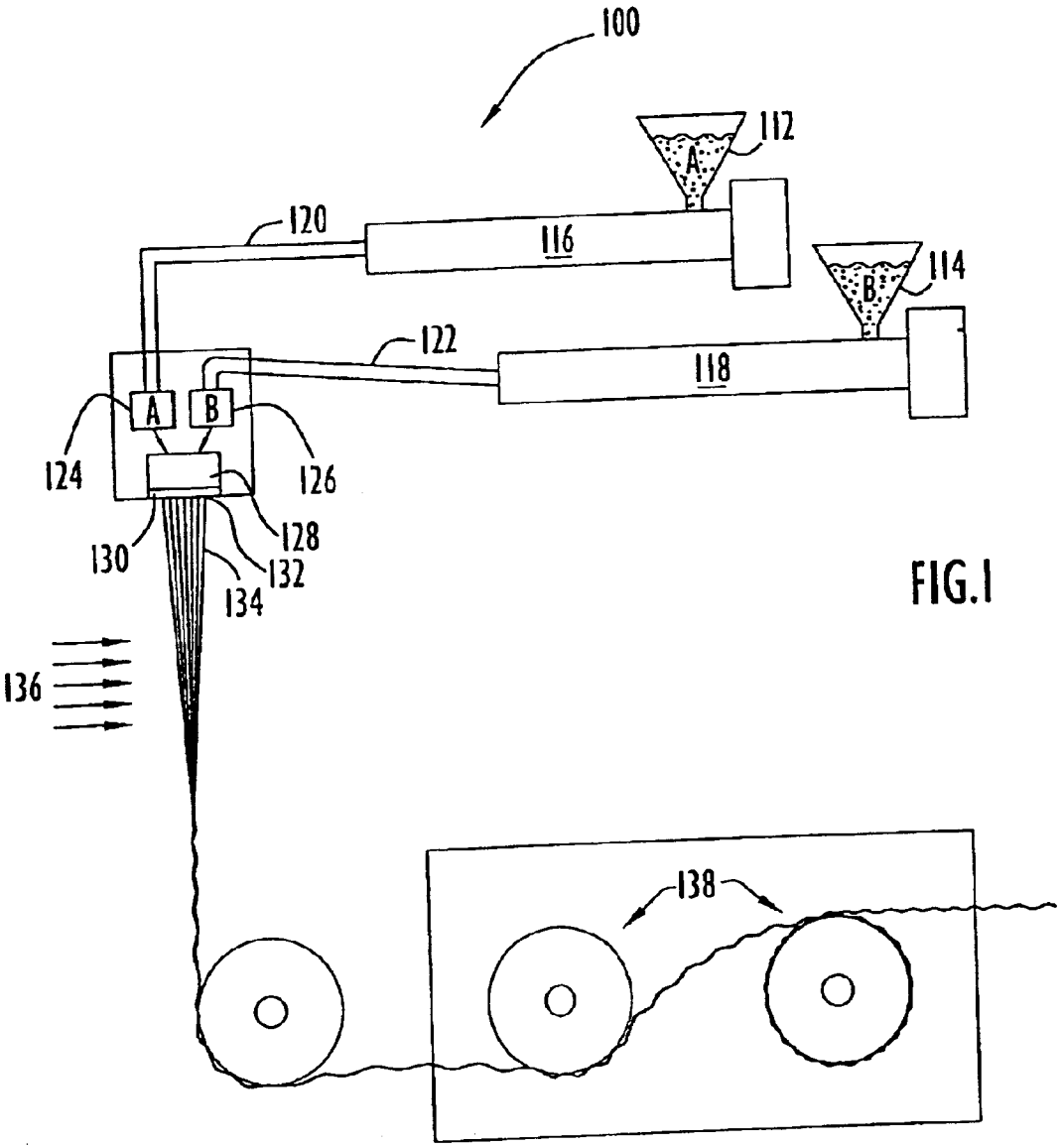
FIG. 1 is a diagrammatic side view in elevation of an assembly for extruding side-by-side bicomponent fibers in accordance with an exemplary embodiment of the present invention.

Multicomponent self-crimping fibers of the present invention are typically manufactured utilizing any extrusion process including, without limitation, melt spinning, wet spinning and dry spinning processes as well as melt blown processes. Referring to FIG. 1, an assembly 100 for extruding side-by-side multicomponent fibers in accordance with an exemplary embodiment of the present invention is shown, wherein the process for manufacturing the fibers is a melt spinning process and the fibers formed are bicomponent fibers. However, it is noted that the present invention is not limited to bicomponent fibers but includes fibers having two or more of the same-polymers forming distinct sections within the fiber. It is further noted that the present invention is not limited to side-by-side fiber configurations but includes any fiber configuration (e.g., sheath-core).

Apparatus 100 includes hoppers 112 and 114 into which pellets of two polymers A and B are respectively placed. As used herein, the terms "polymer A" and "polymer B" refer to the same-polymers, wherein polymer A has a higher viscosity than polymer B. For example, polymer A may be a 0.80 intrinsic viscosity (IV) PET polymer, whereas polymer B may be a 0.62 IV PET polymer. The polymers are fed from their respective hoppers to screw extruders 116 and 118 that melt the polymers. The molten polymers respectively flow through heated pipes 120 and 122 to metering pumps 124 and 126, which in turn feed the two polymer streams to a suitable spin pack 128 with internal parts for forming side-by-side bicomponent fibers of a chosen cross-section.

Spin pack 128 includes a final polymer filtration system, distribution systems and a spinneret 130 with an array of spinning orifices 132 which shape the bicomponent fibers extruded therethrough. For example, orifices 132 may be arranged in a substantially horizontal, rectangular array, typically from 1000 to 5000 per meter of length of the spinneret, with each orifice extruding an individual side-by-side bicomponent fiber. As used herein, the term "spinneret" refers to the lower most portion of the spin pack that delivers the molten polymer to and through orifices for extrusion into the environment. The spinneret can be implemented with holes drilled or etched through a plate or any other structure capable of issuing the required fiber streams.

An array of side-by-side bicomponent fibers 134 exits the spinneret 130 of spin pack 128, and the fibers are quenched as they enter the environment. Typically, a flow of cool air 136 oriented transverse the direction of fiber flow is utilized to quench the fibers immediately upon exiting the spinneret. A drawing force provided by godet rolls 138 (or any other suitable drawing mechanism, e.g., an aspirator) is used to attenuate the extruded fibers. After drawing, the fibers may be processed in any suitable manner to form yarn or woven or non-woven fabric.

When spun together to form a composite fiber, the same-polymer components making up the fiber typically exhibit a distinct boundary between them so that substantially no blending of the differing viscosity polymers occurs. Polymer components that may be utilized in practicing the present invention include, without limitation, polyolefins, polyamides, polyesters, polystyrenics, acrylic polymers, poly-lactic polymers and copolymers, polymer blends and alloys (e.g., polyester and polycarbonate alloys), nylon, and elastomeric polymers such as thermoplastic grade polyurethane. Further, the components may include crystallizing modifying additives (e.g., nucleating agents, crystallization retardants, etc.) and other additives such as dyes and/or pigments. Preferable same-polymer components utilized in the present invention are slow crystallizing polymers, e.g., copolyesters with rigid chain moieties including PET, PBT, poly(trimethylene terephthalate) or PTT, and poly(ethylene naphthalate) or PEN. A most preferable multicomponent fiber produced according to the present invention is a side-by-side stable self-crimping PET/PET fiber.

Figure 2:
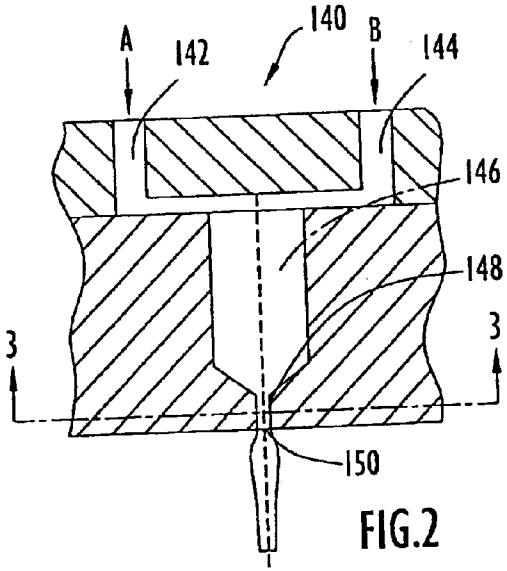
FIG. 2 is a cross-sectional side view in elevation of a spinneret hole of a spinneret for producing a side-by-side bicomponent polymer fiber in accordance with an exemplary embodiment of the present invention.

FIG. 2 illustrates a typical spinneret hole of a spinneret 140 configured to produce a side-by-side bicomponent fiber in accordance with an exemplary embodiment of the present invention. It will be understood that the spinneret includes an array of such spinneret holes to simultaneously produce an array of side-by-side fibers. Spinneret 140 includes channels 142 and 144 which respectively direct streams of molten polymers A and B to the upstream end of a counterbore 146 that tapers at its downstream end to a spinneret hole 148 forming an orifice 150 at the bottom face of spinneret 140. The term "spinneret hole" describes the final capillary-like passage leading to the bottom face of the spinneret through which the side-by-side polymer components flow just prior to being extruded into the environment. Polymers A and B flow side-by-side through counterbore 146, into the spinneret hole 148 and through orifice 150 into the environment.

The key to obtaining a multicomponent self-crimping fiber according to the present invention is to achieve an effective crystallinity differential between two of the same-polymer components of the fiber after extrusion from the spinneret hole. Typically, two or more differing viscosity polymer components will have an effective crystallinity differential when the higher viscosity polymer component is substantially crystalline and the lower polymer component is substantially amorphous prior to final heat setting treatment of the fiber. The higher viscosity polymer component will preferably have a Crystallinity Index (C.I.), as measured by Wide Angle X-Ray Scattering (WAXS), of at least 60%, whereas the lower viscosity polymer component will preferably have a C.I. of less than 20%. Most preferably, the C.I. for the higher viscosity polymer component will approach 80% and the C.I. for the lower viscosity component will be near zero.

An effective crystallinity differential between the same-polymer components may be established by varying a number of fiber processing parameters. In particular, two important parameters that will affect crystallinity are the differing viscosities (e.g., differing IV's) of the polymer components and their transverse cross-sectional geometries upon extrusion from the spinneret hole. The IVs and transverse cross-sectional geometries of each of the polymer components can be selected to ensure that the higher IV polymers crystallize at a faster rate than the lower IV polymers in the quenching process to thus induce a suitable strain differentiation between the polymer components during drawing of the fiber. The quenching temperature and orientation of quenching fluid (e.g., air) on the fiber will further enhance the rate of quench and thus the degree of crystallization for each polymer component. Another important parameter is selection of a suitable draw ratio to initiate or enhance crystallization of the higher IV polymer while the lower IV polymer remains substantially amorphous. Other processing parameters that can affect the crystallinity differential include, without limitation, spinning speed, drawing temperature (e.g., temperature of the godet rolls or the aspirator air temperature) and the ratio of higher IV polymer to lower IV polymer in the multicomponent fiber.

Figure 3:
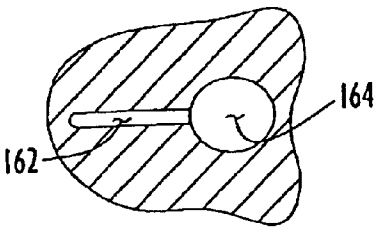
FIG. 3 is a transverse cross-sectional view illustrating the distribution of the higher and lower viscosity polymer components flowing through a spinneret hole having a "keyhole" transverse cross-sectional shape in accordance with one embodiment of the present invention.

Selection of an appropriate geometry for the fiber is important for establishing an appropriate crystallinity differential between the polymer components and thus a desired level of crimp in the resultant fiber. An exemplary geometric embodiment of a bicomponent self-crimping fiber of the present invention is illustrated in FIG. 3, wherein spinneret hole 148 has a "keyhole" cross-sectional shape transverse to the direction of flow of the fiber from the spinneret. Within the "keyhole" cross-section of the spinneret hole, polymer B (i.e., the lower IV polymer component) occupies the "hole" portion 164 of the "keyhole", and polymer A (i.e., the higher IV polymer component) occupies the "arm" portion 162 of the "keyhole". By way of non-limiting example, the "hole" portion 164 may have a diameter of about 0.30 mm, and the "arm" portion 162 may have a length of about 0.35 mm and a width of about 0.2 mm. The "arm" portion provides the higher IV polymer component with a relatively flat, fin-like transverse cross-sectional geometry upon emerging from the spinneret hole. Such a thin and elongated geometry can be described in terms of a perimeter-to-area (P/A) ratio, wherein the area is defined as the cross-sectional area of the polymer component that is transverse the direction in which the polymer component flows through the spinneret hole and the perimeter is the length (or lengths) bounding such area. By increasing the P/A ratio of the higher IV polymer component, the inventor has discovered that an increased crystallinity differential may be obtained between the differing viscosity polymer components.

The cotrelation between the crystallinity differential and the transverse cross-sectional geometries of the higher and lower IV polymer components is explained as follows. Initially, it is noted that fibers having relatively thin, flat and/or elongated transverse cross sections (e.g., ribbon shaped fibers) with high length-to-width ratios typically quench faster and yield highly oriented and thus highly crystallized polymer fibers in comparison to fibers having more rounded (e.g., circular) transverse cross sections. A detailed explanation regarding fiber geometry and corresponding quench rate and degree of crystallization is set forth in co-pending application Ser. No. 09/533,883, filed Mar. 22, 2000 (now U.S. Pat. No. 6,471,910), the disclosure of which is incorporated herein by reference in its entirety. The selection of a transverse cross-sectional geometry that is flat and/or elongated for the higher IV polymer component in the multicomponent fiber will thus increase its quench rate and its resultant degree of crystallization. Furthermore, rounding or squaring of the transverse cross-sectional geometry of the lower IV polymer component, so as to reduce the P/A ratio of the lower IV polymer component with respect to the higher IV polymer component, will lower the quench rate of the lower IV polymer component, thereby increasing the crystallinity differential between the higher and lower IV polymer components. It can thus be seen that a "keyhole" configuration for the fiber, with a rounded geometry (i.e., a low P/A ratio) for the lower IV polymer component and a thin/elongated geometry (i.e., a high P/A ratio) for the higher IV polymer component, is highly effective in achieving an effective crystallinity differential between polymer components of the fiber.

Figure 4:
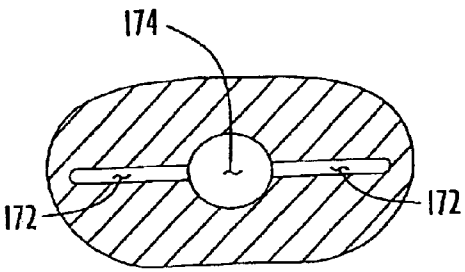
FIG. 4 is a transverse cross-sectional view illustrating the distribution of the higher and lower viscosity polymer components flowing through a spinneret hole having a transverse cross-sectional shape with two "arm" portions extending from a "hole" portion in accordance with another embodiment of the present invention.

An alternative geometric embodiment of a multicomponent self-crimping fiber of the present invention is illustrated in FIG. 4. The transverse cross-section of the fiber of FIG. 4 is similar to the "keyhole" embodiment of FIG. 3 in that a "hole" portion 174 is occupied by polymer B and an "arm" portion 172 extending from the "hole" portion is occupied by polymer A. The geometric embodiment of FIG. 4 further includes a second "arm" portion 172 that extends from "hole" portion 174 approximately 180° from "arm" portion 172 and is also occupied by polymer A. This configuration also yields an effective crystallinity differential during formation of the fiber that results in a stable crimp. The geometry of FIG. 4 further provides a resultant crimp that is tighter than the geometry of FIG. 3 due to a dual effect of the two higher IV "arm" portions helically winding around the lower IV "hole" portion. It is noted that the geometry of FIG. 4 could be further modified to include any number of "arm" portions extending from the "hole" portion at varying angles with respect to each other, wherein higher IV polymer components having the same or different viscosities occupy the "arm" portions, to yield a resultant self-crimping fiber having desirable crimping characteristics.

It is noted that the present invention is not limited to the previously described geometric configurations; rather, a wide variety of geometric configurations are possible including two, three or more polymer components, wherein at least two of the polymer components are same-polymer components. The geometric configurations may also be of any type including, without limitation, side-by-side configurations (i.e., at least one polymer component is arranged adjacent to and shares a common boundary with at least one other polymer component), multilobal configurations and sheath-core or islands-in-the-sea configurations (i.e., at least one polymer component is longitudinally surrounded by another polymer component). In the sheath-core and islands-in-the-sea configurations, the higher viscosity polymer component typically forms the "sheath" or "sea" portion of the fiber to ensure an appropriate degree of crystallinity will be achieved upon quenching of the fiber. Although the geometric configurations for multicomponent fibers formed in accordance with the present invention may vary considerably, it is further noted that preferable geometries are those in which the P/A ratios of the higher IV same-polymer components are greater than the P/A ratios of the lower IV same-polymer components.

Figure 5:
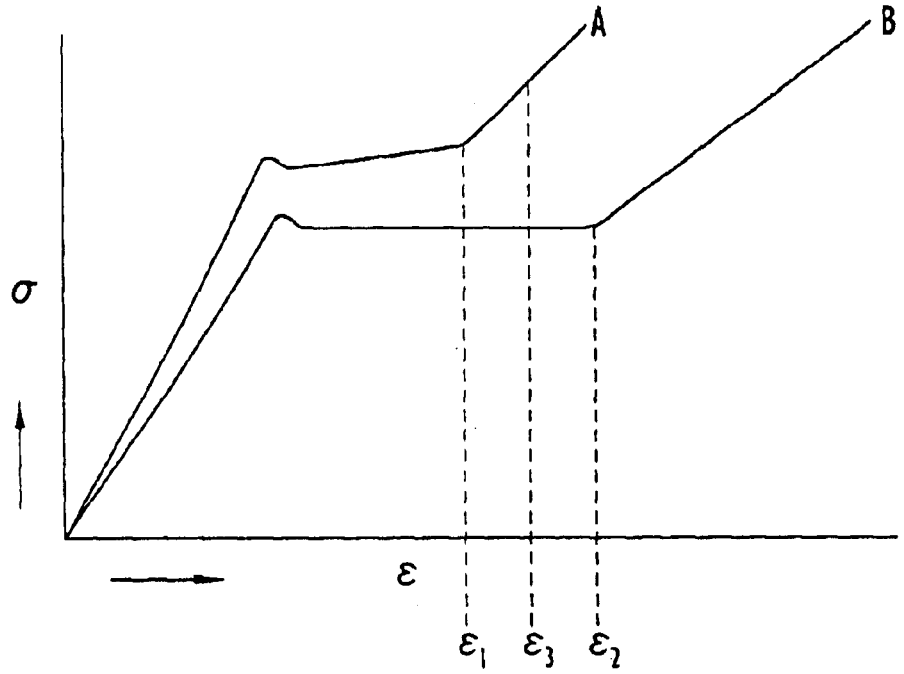
FIG. 5 is a diagram illustrating a typical stress vs. strain relationship for polymers having differing viscosities.

After the fiber has been extruded and quenched to achieve a desired degree of crystallinity in the differing viscosity polymer components, inducement of fiber crimp is typically achieved by subjecting the fiber to a suitable draw tension. The effect of crystallinity differential between differing viscosity polymer portions and the formation of a stable crimp of a resultant multicomponent fiber that occurs upon drawing of the fiber is explained with reference to FIG. 5. Specifically, FIG. 5 illustrates a typical stress ($\delta$) vs. strain ($\in$) curve for two of the same-polymers having differing IVs. Curve A in FIG. 5 represents the stress/strain relationship for the higher IV polymer A, and curve B represents the stress/strain relationship for the lower IV polymer B. The relatively flat portions of the polymer A and polymer B curves indicate regions in which both polymers are in plastic flow during drawing of the multicomponent fiber after extrusion. The point at which each curve begins to slope from the flat portion establishes the onset of strain hardening, wherein each polymer undergoes strain orientation and further crystallization. The sloped portion of the curve for each polymer further indicates the region in which each polymer will exhibit an elastic response to drawing such that, upon release of the draw tension, the polymer will contract to its strain hardened length. As indicated by vertical lines $\in_1$ and $\in_2$ in FIG. 5, the onset of strain hardening for higher IV polymer A typically occurs at a lower strain value as compared to lower IV polymer B.

FIG. 5 further indicates that a draw tension can be selected, e.g., at line $\in_3$, wherein polymer A will exhibit an elastic response or resistance to the draw tension while polymer B still exhibits plastic flow. The selection of a draw tension in such an area leads to a strain differential and further crystallinity differential between polymers A and B, which in turn results in contraction of polymer A with respect to polymer B upon releasing the draw tension. As the crystallinity differential increases between polymer A and polymer B components, the elastic response and contraction of polymer A upon release of the draw tension is further enhanced resulting in formation of crimp in the fiber. Thus, it can be seen that an effective crystallinity differential leads to the development of a stable crimp upon applying a suitable draw tension to the multicomponent fiber. Additionally, a suitable draw tension can further enhance the degree of crystallinity of the higher polymer IV component thus ensuring an effective crystallinity differential develops between the higher and lower IV components.

The draw tension applied to a fiber in a fiber forming process is typically described in terms of a draw ratio, i.e., a ratio of drawn fiber length to initial fiber length. Selection of a suitable draw ratio that will ensure an adequate degree of contraction of the higher viscosity polymer components upon release of draw tension will depend upon similar factors associated with development of crystallinity differential. In an exemplary fiber embodiment utilizing PET components having differing viscosities of about 0.70–0.80 IV for one PET component and about 0.60–0.65 IV for another PET component, suitable draw ratios that will achieve a stable crimp for the fiber are typically within the range of about 1.4 to about 1.7.

Figure 6:
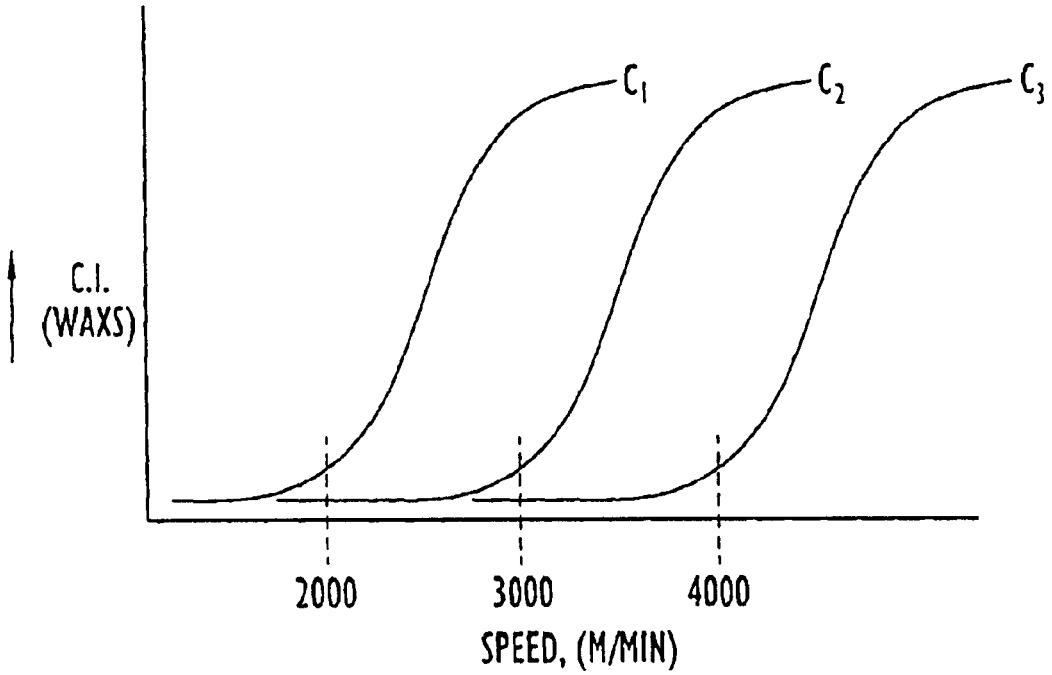
FIG. 6 is a diagram illustrating the effect of varying the quench rate and spinning speed on degree of crystallization for homofilaments of PET drawn in a conventional melt spinning process.

Selection of a spinning speed for a fiber extrusion process will also have an effect on the degree of crystallinity and thus crystallinity differential for the differing viscosity polymer components of the multicomponent fiber. The effect of spinning speed on degree of crystallinity is illustrated in FIG. 6 and described as follows. FIG. 6 depicts a plot of C.I. (measured by WAXS) for round transverse cross-sectional homofilaments of PET vs. spinning speed. Curves $C_1$, $C_2$ and $C_3$ in FIG. 6 clearly indicate that an increase in spinning speed in a fiber spinning process will typically result in a rapid increase in degree of crystallization of the polymer upon reaching the onset of crystallization (i.e., the steep slope portion of each curve). A comparison of curves $C_1$, $C_2$ and $C_3$ also indicates that the quench rate will affect the degree of crystallization of the polymer at a set spinning speed. Specifically, curve C, has a greater quench rate than curve $C_2$, and curve $C_2$ has a greater quench rate than curve $C_3$. As is evident from the curves, the lowest "threshold" spinning speed that will lead to the onset of crystallization occurs at curve $C_1$. In other words, lowering the spinning speed requires an increase in quench rate to ensure the onset of crystallization in the polymer. Thus, a desired degree of crystallization may be induced in a polymer component of a multicomponent fiber of the present invention at lower spinning speeds by increasing the P/A ratio of that polymer component.

The data presented in FIG. 6 is particularly useful when considering spinning conditions required for certain types of fibers. For instance, the formation of a partially oriented yarn (POY) requires a spinning speed for forming the fiber typically in the range of about 2000–3500 n/min. Therefore, providing a suitable elongated geometry for the higher IV polymer portion, such as the "arm" in a keyhole configuration, will ensure the onset of crystallization and enhance the degree of crystallinity in that portion at POY spinning speeds. Additionally, providing a rounded geometry for the lower IV polymer portion, such as the "hole" in the keyhole configuration, at POY spinning speeds will inhibit the onset of crystallization and thus increase the crystallinity differential between the higher and lower IV polymer components of the fiber.

Additional factors that influence the crystallinity differential between higher and lower viscosity polymer components are the orientation of quench air flow and temperature operating conditions at various processing steps. Regarding quench orientation, it is preferable to ensure the higher viscosity polymer component is directly exposed to the flow of quenching air. Referring to FIG. 1, the direction of cool air 136 is typically aligned such that a higher viscosity polymer component is upstream in the air stream in relation to a lower viscosity polymer component. Such direct contact with the air enhances the quench rate and degree of crystallization of the higher viscosity polymer component. The quench air temperature and velocity may also be selected to enhance the quench rate of the polymer components.

The rate of crystallization of the polymer components can further be adjusted by selecting a suitable drawing temperature. Specifically, the rate of crystallization of certain polymers may be maximized at a selected range of temperatures. For example, the crystallization rate of PET may be maximized within a temperature range of about 110–140° C., most preferably within a range of about 120–130° C. Maximizing the crystallinity rate of the polymer components during drawing will ensure the higher IV polymer component achieves a desirable degree of crystallinity.

Typically, the multicomponent fiber will exhibit suitable crimping characteristics after the fiber has been drawn at a suitable draw ratio. However, an optional thermal treatment step may be provided after the fiber is drawn to further enhance the fiber crimp. This thermal treatment step may be useful under certain conditions where a the higher viscosity polymer components of the fiber have not fully crystallized after being quenched and drawn. The optional thermal treatment step may be implemented as follows. Specifically, after the fiber has been drawn and a certain level of crimping has been induced, the crimp may be accentuated by subjecting the fiber to a heat source, e.g., steam or heated air, at a suitable temperature, e.g. about 100° C. The thermal step will have the effect of further crystallizing the higher viscosity polymer component causing it to shrink in relation to the lower viscosity polymer component.

The following example describes a specific method for forming side-by-side PET/PET elf-crimping fibers in accordance with the present invention. Specifically, side-by-side ET/PET fibers were prepared utilizing a melt extrusion apparatus substantially similar to the apparatus illustrated in FIG. 1, with a selected spinning speed of 2750 m/min. A "keyhole" transverse cross-sectional geometry substantially similar to the geometry illustrated in FIG. 3 was selected for the fibers, with the "arm" portion of the "keyhole" containing a 0.71 IV PET and the "hole" portion containing a 0.61 IV PET. The fibers were extruded and quenched utilizing cool air at a velocity of about 0.4 m/s and a temperature of about 22° C. The quenching air stream was directed at the extruded fibers such that the higher IV PET component (i.e., the "arm" portion) was upstream in the air flow with respect to the lower IV PET component. After quenching, fibers were drawn onto two heated godet rolls at a draw ratio of 1.45. The first godet roll was heated to a temperature of 100° C., and the second godet roll was heated to a temperature of 130° C. The fibers were subsequently heat set at 130° C. in a dry oven. The resultant fibers were determined to have a stable crimp that could not be removed by straining the fibers. Additionally, the PET/PET fibers were compared to sample PET/PBT fibers by hanging weights from the fibers for selected time intervals and then removing the weights to determine the level of elongation of the fibers. The PET/PET fibers exhibited similar levels of elongation as the PET/PBT fibers when subjected to the same amount of strain by the hanging weights.

The specific embodiments illustrated and described herein are intended to be exemplary and not limiting on the scope of the invention. The specific embodiments have been provided to show how different parameters may be varied to achieve an effective crystallinity differential between at least two of the same-polymer components in a multicomponent fiber so as to induce a stable crimp in the resultant fiber.

It is noted that the transverse cross-sectional geometries of the differing viscosity polymer components may be of any configuration that achieves a faster quench rate for the higher viscosity polymer components and thus leads to an effective crystallinity differential. It is further noted that, although selection of a draw ratio may be important to establish an effective crystallinity differential and induce crimping in the fiber, application of a draw tension on the fiber is not essential in practicing the present invention. Suitable polymer component geometries and differing viscosities may be selected such that an effective crystallinity will result upon quenching of the fiber. Once an effective crystallinity is established, the fiber maybe subjected to suitable heat treatment rather than strain to induce desirable crimping characteristics.

The present invention vastly improves upon the methods of manufacturing self-crimping multicomponent fibers having the same-polymer components as well as crimp stability of the resultant fiber. In particular, various combinations of same-polymer components can now be used to form self-crimping multicomponent fibers by easily varying certain operating parameters during the fiber forming process. These crimped fibers can be manufactured into a number of textile applications including, without limitation, partially and fully oriented yarns and woven fabrics and non-woven webs or fabrics. The yarns and fabrics may contain solely self-crimping multicomponent fibers of the present invention or some self-crimping multicomponent fibers along with other types of fibers. Further, the crimped fibers of the present invention are useful in any product where properties such as softness, strength, filtration or fluid barrier properties, and high coverage at a low fabric weight are desirable or advantageous. For example, the fibers produced by the methods and apparatus of the present invention can be used in a variety of commercial products including, but not limited to: softer diaper liners, sanitary napkins, disposable wipes or other disposable absorbent articles; medical fabrics having barrier properties such as surgical gowns and drapes and sterilization wraps; filtration media and devices; and liners for articles of clothing (e.g., a liner of a jacket).

The present invention is not limited to the particular apparatus and processes described above, and additional or modified processing techniques are considered to be within the scope of the invention. For example, any number or combination of fiber processing techniques, yarn forming techniques, and woven and non-woven fabric formation processes can be applied to the multicomponent fibers formed in accordance with the present invention. Conventional woven and nonwoven fabric processes are well known in the art as described in co-pending application Ser. No. 09/647,236, filed Sep. 25, 2000, the disclosure of which is incorporated herein by reference in its entirety. For example, nonwoven webs may be produced using a spunbond process, wherein a plurality of extruded fibers are randomly laid on a forming surface, such as a moving conveyor belt, to form a continuous nonwoven web of fibers. The extruded fibers may be entirely self-crimping multicomponent fibers of the present invention. Alternatively, the extruded fibers may contain some self-crimping multicomponent fibers as well as other types of fibers that may or may not crimp. The web is subsequently bonded using one of several known techniques to form the nonwoven fabric, e.g., by being pressed between a pair of hot calender rolls. Carded or air-laid webs can also be formed from these polymers. In the case of woven fabrics, the extruded fibers are typically wound on a bobbin. Thereafter, in a separate process, a conventional knitting or weaving technique is employed to form a woven fabric from the fibers. The woven fabrics may also contain entirely self-crimping multicomponent fibers of the present invention or, alternatively, some self-crimping multicomponent fibers as well as other types of fibers that may or not crimp.

Having described preferred embodiments of new and improved method of forming self-crimping multicomponent fibers, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. A method of forming a self-crimping multicomponent fiber comprising:

(a) passing a plurality of streams of polymer components through a spinneret hole, wherein the plurality of streams includes a first polymer component and a second polymer component, the first and second polymer components are same-polymer components and the first polymer component includes a higher viscosity than the second polymer component;

(b) extruding the plurality of streams from the spinneret hole, wherein the streams combine to form the multicomponent fiber;

(c) quenching the multicomponent fiber at a location downstream from the spinneret hole; and (d) establishing an effective crystallinity differential between the first and second polymer components of the multicomponent fiber by at least the combination of selecting a suitable viscosity differential between the first and second polymer components and selecting a suitable perimeter-to-area ratio of transverse cross-sections of the first and second polymer components, wherein the transverse cross-section of the first polymer component differs from the transverse cross-section of the second polymer component.

2. The method of claim 1, wherein (d) includes:

(d1) selecting a perimeter-to-area ratio of the first polymer component that is greater than a perimeter-to-area ratio of the second polymer component.

3. The method of claim 2, wherein (b) includes:

(b1) extruding the first polymer component through a portion of the spinneret hole having an elongated geometry and the second polymer component through a portion of the spinneret hole having a geometry selected from the group consisting of substantially round and substantially square, wherein the first and second polymer components emerge from the spinneret hole adjacent each other with transverse cross-sectional geometries substantially similar to their respective spinneret hole portions.

4. The method of claim 3, wherein the plurality of streams further includes a third polymer component with a higher viscosity than the second polymer component, and (b1) includes:

(b11) extruding the third polymer component through a portion of the spinneret hole having an elongated geometry, wherein the third polymer component emerges from the spinneret hole adjacent the second polymer component with a transverse cross-sectional geometry substantially similar to its respective spinneret hole portion.

5. The method of claim 1, wherein (c) includes:

(c1) directing a stream of air toward the multicomponent fiber, wherein the first polymer component is upstream in the air stream in relation to the second polymer component.

6. The method of claim 1, wherein (d) includes:

(d1) establishing the effective crystallinity differential by varying at least another parameter selected from the group consisting of draw ratio, draw temperature and spinning speed; and the method further comprises:

(e) drawing the quenched multicomponent fiber to induce crimping of the multicomponent fiber.

7. The method of claim 6, further comprising:

(f) heating the drawn multicomponent fiber to a selected temperature to induce further crimping of the multicomponent fiber.

8. The method of claim 6, wherein the first and second polymer components arc PET.

9. The method of claim 8, wherein (d) includes:

(d1) selecting a draw temperature in a range of between about 110° C. and about 140° C.

10. The method of claim 8, wherein (d) includes:

(d1) selecting a draw ratio between about 1.4 to about 1.7.

11. The method of claim 1, wherein (b) includes:

(b1) extruding the plurality of streams such that a portion of the transverse cross-section of the first polymer component is adjacent a portion of the transverse cross-section of the second polymer component.

12. The method of claim 1, wherein (b) includes:

(b1) extruding the plurality of streams such that a transverse cross-section of one of the first and second polymer components is surrounded by a transverse cross section of the other of the first and second polymer components.

13. The method of claim 12, wherein the transverse cross-section of the second polymer component is surrounded by the transverse cross-section of the first polymer component.

14. A method of forming a fabric comprising:

(a) combining a plurality of fibers, wherein at least one of the fibers is a multicomponent self-crimping fiber manufactured according the method of claim 1.

15. The method of claim 14, wherein (a) includes:

(a1) combining the plurality of fibers to form one of a woven fabric and a non-woven web.

16. A crimped, multicomponent fiber comprising a plurality of polymer components including a first polymer component and a second polymer component, wherein the first and second polymer components are same-polymer components, the first polymer component includes a higher viscosity than the second polymer component, each of the first and second polymer components includes a transverse cross-sectional geometry configured to achieve an effective crystallinity differential between the first and second polymer components during formation of the fiber, and the transverse cross-sectional geometry of the first polymer component differs from the transverse cross-sectional geometry of the second polymer component.

17. The fiber of claim 16, wherein the transverse cross-sectional geometry of the first polymer component includes a greater perimeter-to-area ratio than the transverse cross-sectional geometry of the second polymer component.

18. The fiber of claim 17, wherein the transverse cross-sectional geometry of the first polymer component is elongated and the transverse cross-sectional geometry of the sccond polymer component is selected from the group consisting of substantially round and substantially square.

19. The fiber of claim 18, wherein the plurality of same-polymer components further includes a third polymer component including a higher viscosity than the second polymer component and a transverse cross-sectional geometry that is elongated.

20. The fiber of claim 16, wherein a portion of the transverse cross-sectional geometry of the first polymer component is adjacent a portion of the transverse cross-sectional geometry of the second polymer component.

21. The fiber of claim 16, wherein the transverse cross-sectional geometry of one of the first and second polymer components is surrounded by the transverse cross-sectional geometry of the other of the first and second polymer components.

22. The fiber of claim 21, wherein the transverse cross-sectional geometry of the second polymer component is surrounded by the transverse cross-sectional geometry of the first polymer component.

23. The fiber of claim 16, wherein the first and second polymer components are PET. present invention is illustrated in FIG. 4. The transverse cross-section of the fiber of FIG. 4 is similar to the "keyhole" embodiment of FIG. 3 in that a "hole" portion 174 is occupied by polymer B and an "arm" portion 172 extending from the "hole" portion is occupied by polymer A. The geometric embodiment of FIG. 4 further includes a second "arm" portion 172 that extends from "hole" portion 174 approximately 180° from "arm" portion 172 and is also occupied by polymer A. This configuration also yields an effective crystallinity differential during formation of the fiber that results in a stable crimp. The geometry of FIG. 4 further provides a resultant crimp that is tighter than the geometry of FIG. 3 due to a dual effect of the two higher IV "arm" portions helically winding around the lower IV "hole" portion. It is noted that the geometry of FIG. 4 could be further modified to include any number of "arm" portions extending from the "hole" portion at varying angles with respect to each other, wherein higher IV polymer components having the same or different viscosities occupy the "arm" portions, to yield a resultant self-crimping fiber having desirable crimping characteristics.

* * * * *